US005358291A

United States Patent [19]

Malmanger et al.

[11] Patent Number: 5,358,291

[45] Date of Patent: Oct. 25, 1994

[54] HATCH WITH IMPROVED LATCH AND HINGE ASSEMBLY

[75] Inventors: John A. Malmanger, SeaTac; Kim Hunter, Gig Harbor, both of Wash.

[73] Assignee: Tempress, Inc., Seattle, Wash.

[21] Appl. No.: 96,601

[22] Filed: Jul. 22, 1993

Related U.S. Application Data

[62] Division of Ser. No. 906,824, Jun. 30, 1992, Pat. No. 5,231,948.

[51] Int. Cl.[5] ..... E05C 1/10

[52] U.S. Cl. ..... 292/175; 292/256.5; 292/87; 292/DIG. 38; 292/DIG. 63

[58] Field of Search ..... 292/175, 256.5, DIG. 38, 292/DIG. 63, 76, 80, 87

[56] References Cited

U.S. PATENT DOCUMENTS 3,850,464 11/1974 Bisbing et al. ..... 292/175
4,223,787 9/1980 Lowry et al. ..... 292/175 X
4,320,834 3/1982 Tamaki ..... 292/175
4,790,579 12/1988 Maxwell et al. ..... 292/DIG. 38 X

*Primary Examiner*—Rodney M. Lindsey
*Attorney, Agent, or Firm*—Christensen, O'Conner, Johnson & Kindness

[57] ABSTRACT

A hatch for a boat or other application is provided. The hatch includes a frame for mounting in an opening in a panel and a hatch cover pivotally mounted thereto. The cover includes a hinge pin that pivotally engages a hinge receptacle mounted on the frame. A handle is slidably mounted in the hatch cover and includes a latch that releasably engages the frame when the hatch is in a closed and latched position.

16 Claims, 9 Drawing Sheets

HATCH WITH IMPROVED LATCH AND HINGE ASSEMBLY

This is a divisional of the prior application Ser. No. 07/906,824, filed Jun. 30, 1992, now U.S. Pat. No. 5,231,948.

FIELD OF THE INVENTION

The present invention relates to hatches mountable on an interior or exterior panel, such as a deck or bulkhead of a boat. More specifically, the invention relates to hatches as above that are attached to the panel through the use of a releasable hinge assembly and that include a slidable latch mechanism that secures the hatch adjacent to the panel.

BACKGROUND OF THE INVENTION

There are many applications that use hatch assemblies, such as interior or exterior hatches used on the decks or bulkheads of a boat or in the cabinetry of recreational vehicles. In some applications, it is desirable for the hatch to be releasable from the surface upon which it is mounted in order to prevent inadvertent breaking and also to increase access through the hatch. It is also desirable that the hatches be durable and aesthetically pleasing. One example of a prior art releasable hatch is disclosed in U.S. Pat. No. 4,846,089, issued to Cedergreen. The Cedergreen patent discloses a hatch having a multiple piece releasable hinge assembly comprising an arcuate flange positioned adjacent to an up-standing step such that the combination of the up-standing step and arcuate flange rotatably receive and hold the hatch cover's hinge pins. Although the Cedergreen hatch cover is capable of being releasably attached to the surface, its multiple piece design may increase manufacturing costs and affect the aesthetics of the hatch.

It is also desirable for a hatch to have a simple, highly durable, positive latch mechanism for maintaining the hatch cover in a closed position. This is particularly important on boats where an inadvertently opened hatch could result in water flowing through the hatch or in boats or recreational vehicles where items contained within the hatch could spill out as the vehicles move. Furthermore, in rough water it could be difficult for the operator to latch or unlatch a cover having an improperly designed latch mechanism.

SUMMARY OF THE INVENTION

A hatch according to the present invention allows the hatch cover to be released from the surface upon which it is attached. This helps to prevent possible damage to the hatch cover and increases access through the hatch. The hatch also includes a slidable handle having a latch which engages a latch receptacle on the surface to which the hatch is attached in order to hold the hatch cover in a closed and latched position. The slidable handle allows for easy operation of the hatch.

One embodiment of the present invention includes a cover having a hinge side and a latch side. The hatch also includes a latch means, on the latch side, for releasably engaging the panel when the cover is in a closed and latched position. A hinge means, located on the hinge side, pivotally couples the cover to the panel. The hinge means includes a hinge pin having a predetermined cross-sectional area and a hinge receptacle adapted to releasably engage the hinge pin. The hinge receptacle includes an arcuate flange positioned in a horizontally opposed facing relationship with a bearing surface to define a channel having orientated parallel to the hinge pin and an opening into the channel over the channel's length. The channel is sized to receive the hinge pin and the width of the opening is dimensioned smaller than the cross-sectional dimension of the hinge pin. The channel and bearing surface are adapted to releasably hold the hinge pin so that it is free to rotate. In addition, the hinge receptacle is constructed of a material which allows the outer edge of the arcuate flange to be displaced from the surface sufficiently to permit the hinge pin to pass through the opening and into and out of the channel such that the hinge pin may snap into and out of the channel.

According to other aspects of the invention, the hinge pin includes at least one band extending outwardly from its exterior surface and the arcuate flange includes a groove adapted to receive the band. This arrangement prevents axial movement of the hinge pin within the channel. The hinge receptacle also includes two lower flanges located in an opposed facing relationship with the arcuate flange in order to rotatably hold the hinge pin between the arcuate flange and lower flanges.

The hatch cover also includes a handle receptacle located on the latch side. A handle is slidably received within the handle receptacle and held there by retaining means. Sliding the handle from a latched position to an unlatched position disengages a latch means from the panel and allows the cover to be opened. In addition, a biasing means biases the handle toward the latched position.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The present invention is described herein with reference to a preferred configuration as a hatch for a boat. It is to be understood, however, that the present invention is not limited to boat applications. The hatch may be mounted in an opening on any panel such as a bulkhead, deck, wall, or floor of a boat or any other structure. Furthermore, although the present invention is described with reference to a preferred configuration mounted horizontally on the deck of a boat, it may be reorientated vertically resulting in corresponding changes in the orientation of the parts of the hatch. References to orientation refer solely to the orientation of the pans of the hatch with respect to each other and not to orientation in space.

Figure 1:
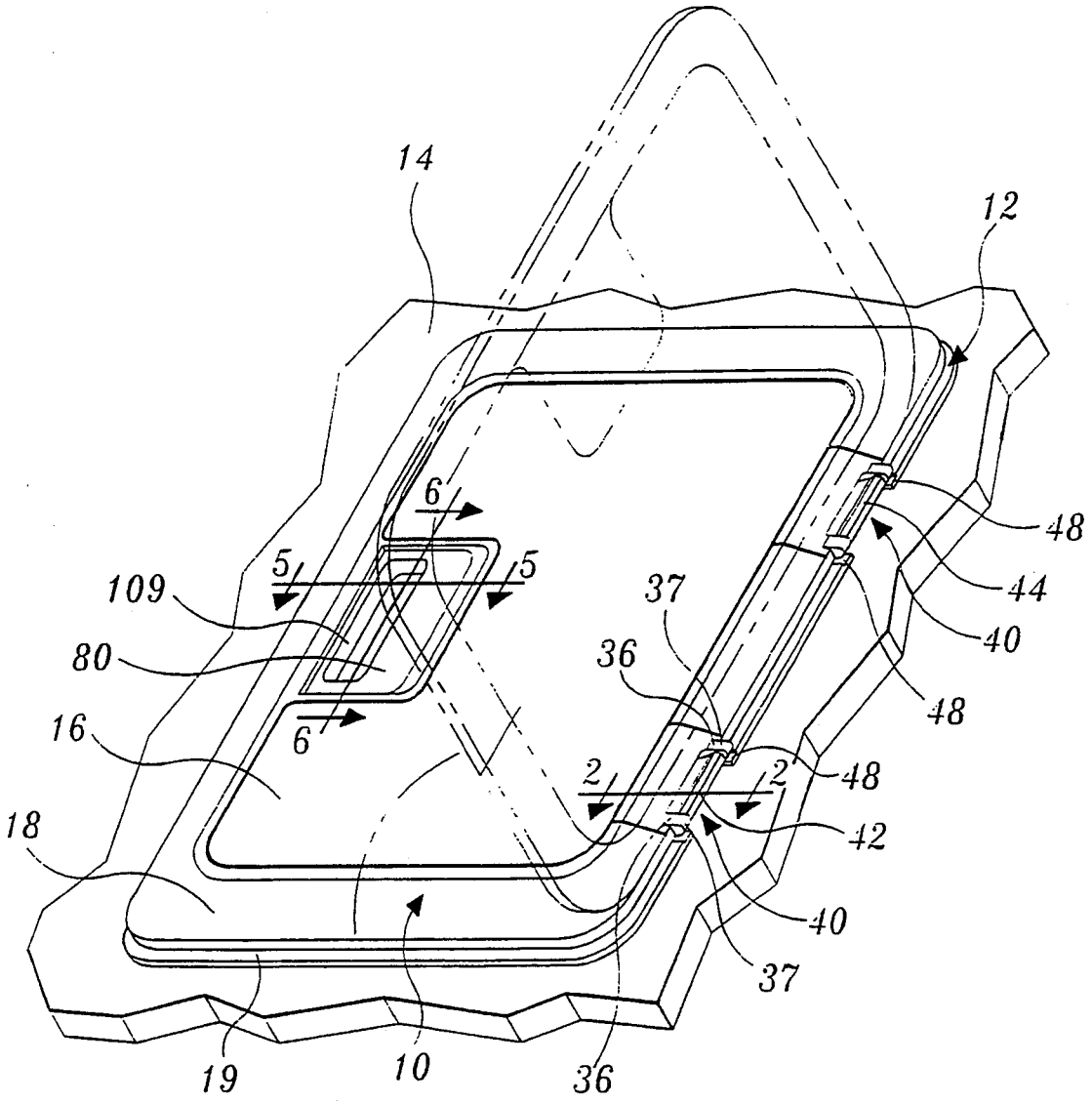
FIG. 1 is a perspective view of a hatch according to the present invention installed on a panel; .

Referring initially to FIG. 1, the preferred embodiment of the hatch includes a generally rectangular frame 12 designed to be mounted in an opening on a deck 14. A hatch cover 10 is pivotally connected to the frame 12 through the use of two hinge assemblies 40 located along one side of the hatch cover and a handle 80 slidably mounted on the opposite side of the hatch cover. The hinge assemblies 40 allow the hatch cover 10 to be moved from a closed and latched position as shown in FIG. 1 to an open and unlatched position in which the hatch cover lies parallel to the upper surface of the deck, 180° from the orientation shown (the hatch cover 10 is shown partially open in phantom in FIG. 1). The hatch cover is opened by sliding the handle 80 rearwardly toward the opposite side of the hatch cover. This action disengages a latch mechanism, as will be described hereinafter, and allows the hatch cover to be opened by pivoting the hatch cover on the hinge mechanisms 40.

Figure 11:
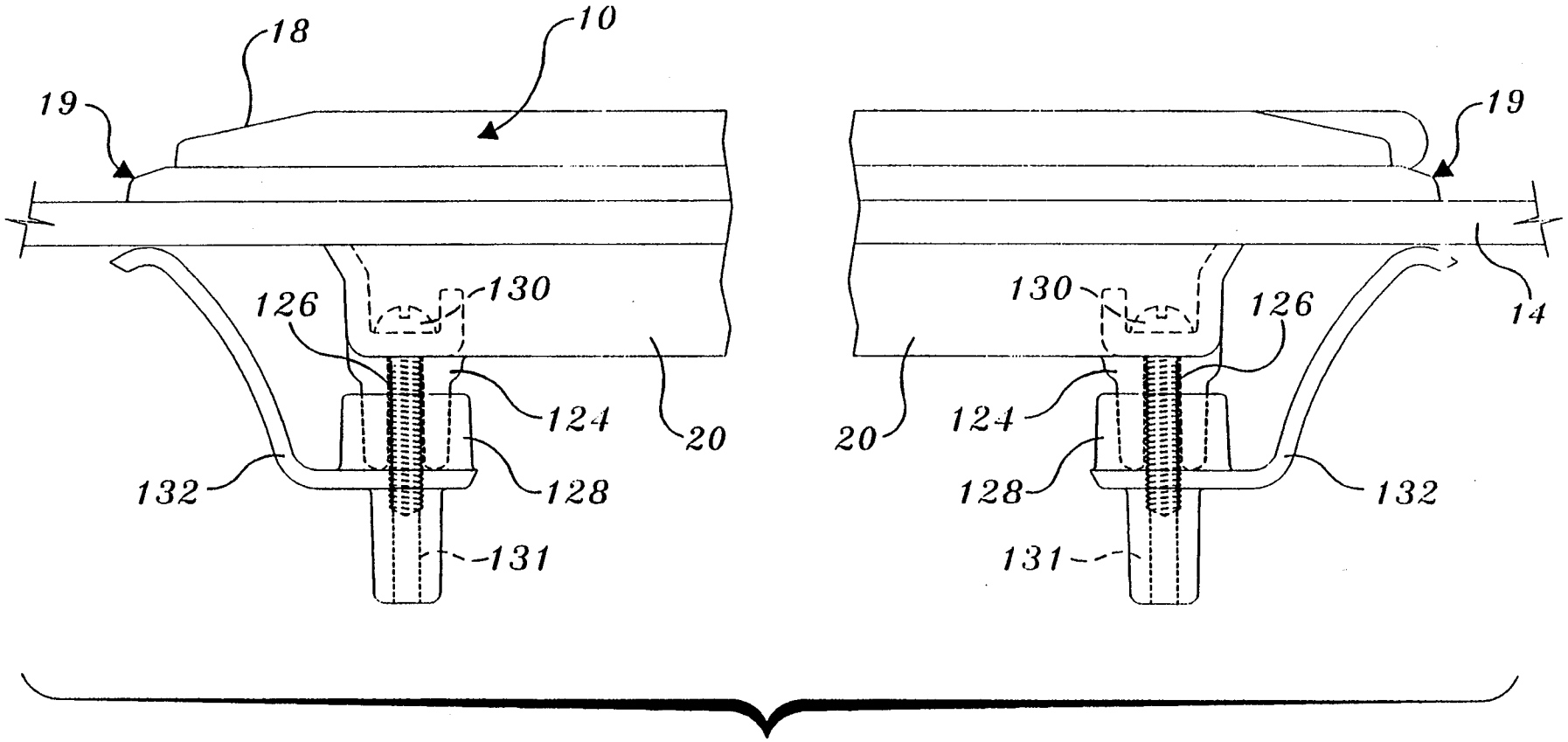
FIG. 11 is an enlarged elevation view in partial cross section of a bracket to attach the hatch of FIG. 1 to a panel.

The hatch cover 10 is generally rectangular, with a planar top 16 and a downwardly sloping edge 18 as best viewed in FIGS. 1 and 11. The hatch cover 10 and frame 12 have rounded comers and are complementary shaped to fit together and provide an aesthetically pleasing appearance.

Frame 12 includes a generally rectangularly shaped skirt or rim 19 (FIGS. 1, 2 and 5) extending parallel to the upper surface of the deck 14 to define a hatch opening. The lower surface of the rim 19 rests on the upper surface of the deck 14 and includes a plurality of apertures 26 (FIG. 5) located around the periphery of the rim. Each aperture 26 is adapted to receive a fastener 28, such as a bolt or screw that extends through the rim and into the deck in order to attach the hatch to the deck. The lower surface of the rim may beneficially include a number of channels 30 that extend parallel to the edge of the hatch opening around the periphery of the rim. Each channel 30 may be filled with a sealing compound to ensure that a proper seal is maintained, thus preventing fluid flow in between the frame and the deck.

The inner edge of the rim 19 adjacent the hatch opening includes a downwardly extending J-shaped edge 20 (FIGS. 2 and 5) that extends around the periphery of the opening in the panel and that further defines the hatch opening. The bottom edge of the J-shaped edge 20 defines an upwardly facing U-shaped seal channel 22 that is adapted to receive a specially configured seal 24. The portion of the J-shaped edge 20 opposite the handle 80 also includes a retaining groove 122 (FIG. 5) that serves as a latch receptacle and engages a latch 116 on the handle as will be described hereinafter.

Seal 24 is constructed from an elastomeric material, such as neoprene. In its undeformed configuration (shown in phantom in FIGS. 2 and 5), the seal 24 has a generally rectangular cross-sectional shape and is provided with a centrally located bore 56. Alternate seal configurations having different cross sections could also be used. The lower surface of the seal includes two downwardly extending parallel legs 25 that define a channel 58 running the length of the seal. When the hatch cover 10 is in a closed position, a downwardly extending peripheral wall 60 of the hatch cover extends into the seal channel 22 and contacts and compresses the seal 24, thus preventing fluid flow through the hatch into the interior of the boat. During compression, the two legs 25 of the seal spread horizontally apart from each other and contact the opposing walls of the seal channel 22, thus forming a better seal. In addition to the seal 24, the downwardly sloping edge 18 (FIGS. 1 and 5) of the hatch cover extends parallel to the upper surface of the deck over the upper surface of the rim 19, thus helping to prevent water from flowing in between the hatch cover and rim into the interior of the boat. The rim also extends over and hides the fasteners 28 when the hatch cover is closed.

Figure 2:
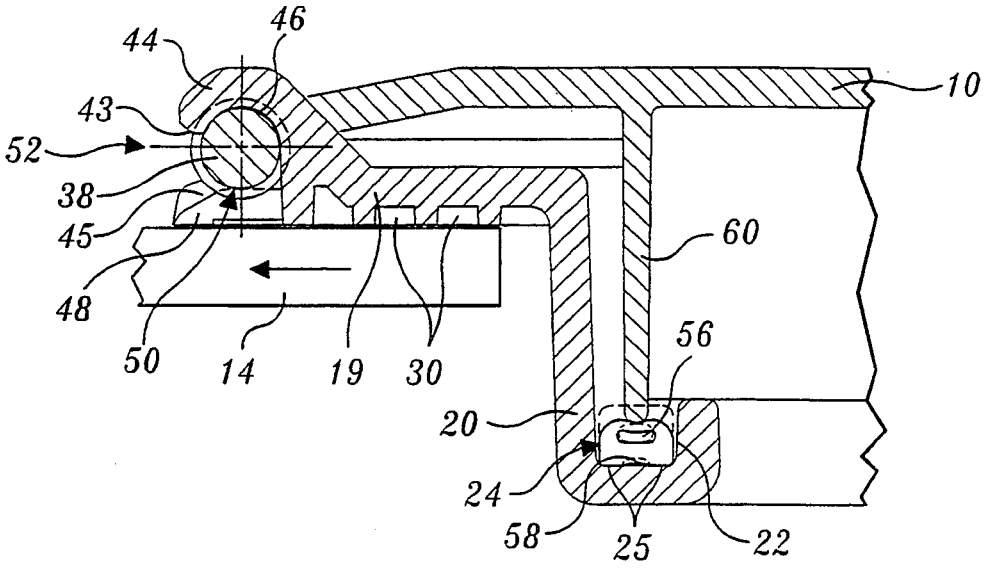
FIG. 2 Is an enlarged partial cross section of the hatch and hinge mechanism taken along section line 2—2 of FIG. 1.
Figure 3:
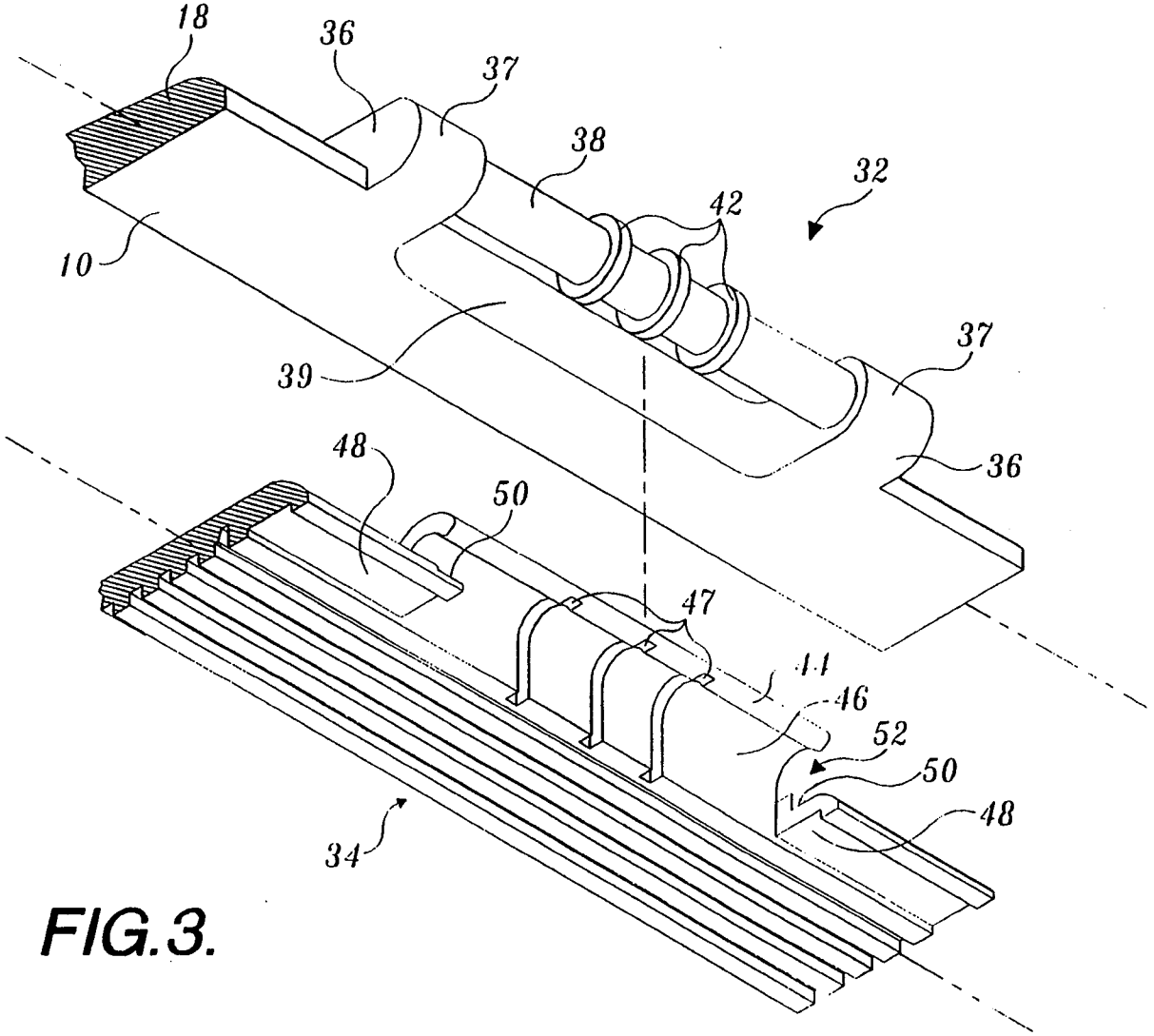
FIG. 3 is an enlarged exploded view of the hinge mechanism of FIG. 1.

As best viewed in FIGS. 1 through 3, two hinge assemblies 40 are longitudinally spaced along the edge of the hatch opposite the handle 80. In the preferred embodiment, each hinge assembly includes a hinge bracket 32 formed as an integral part of the hatch cover and a hinge receptacle 34 formed as an integral part of the frame 12. In alternate embodiments not shown, the structure of the hinge assemblies could be reversed, thus having a hinge receptacle as an integral part of the hatch cover and a hinge bracket as an integral part of the frame.

Each hinge bracket 32 includes two arms 36 longitudinally spaced apart and extending perpendicular to and outwardly past the edge of the hatch cover. The outer end 37 of each arm 36 is rounded in order to serve as a bearing as will be described below. A cylindrical hinge pin 38 extends parallel to the edge of the hatch cover in between the ends of the arms 36. The arms 36 extend a sufficient distance past the edge of the hatch cover to maintain a gap 39 in between the edge of the hatch cover and the hinge pin 38.

The hinge pin 38 includes three parallel longitudinal spaced bands 42 that encircle the hinge pin and extend outwardly perpendicular to the outer surface of the hinge pin. Although the preferred embodiment is shown with three bands 42, other numbers of bands may also be used. The bands prevent axial movement of the hinge pin within the hinge receptacle as will be described hereinafter.

The hinge receptacles 34 are located on the frame 12 and adapted to receive and releasably engage the corresponding hinge bracket 32. Each hinge receptacle includes an arcuate flange 44 and two longitudinal spaced-apart lower flanges 48 that extend longitudinally along the outer edge of the rim 19 parallel to the hinge pins 38. The lower flanges 48 are positioned in an opposed facing relationship to the arcuate flange. The arcuate flanges 44 extend upwardly from the rim 19 through the gaps 39 between the edge of the hatch cover and the hinge pins 38. The arcuate flanges then arch outwardly over the hinge pins forming an inner surface 46 adapted to conform to the outer surface of the hinge pins 45. Three parallel, longitudinal spaced grooves 47 extend around the inner surface 48 of the arcuate flange and are positioned so as to receive the bands 42 on the hinge pins, thus preventing the hinge pins from moving axially within the arcuate flange.

In alternate embodiments (not shown), the grooves could be located on the hinge pin and the outwardly extending bands could be ridges on the inner surface of the arcuate flange. The ridges would engage the grooves in the hinge pin when the hinge pin is snapped within the arcuate flange, thus preventing movement of the hinge pin axially within the hinge receptacle.

The upper surfaces 50 of the lower flanges face the arcuate flange and serve as a bearing surface on which the ends 37 of the arms pivot when the hatch cover is moved from its closed and latched position to its open position or vice-versa as will be described in more detail hereinafter. The outermost edges 43 and 45 of the arcuate flange and lower flanges, respectively, are beveled in order to assist in snapping the hinge pin 38 into the hinge receptacle as described below.

The arcuate flange 44, lower flanges 48 and upper surface of the deck define a channel that extends parallel to the edge of the rim and hinge pin and is sized to receive and conform to the outer surface of the hinge pin 38. The arcuate flange, lower flanges and deck also define an opening 52 (FIG. 2) into the channel. The opening 52 extends longitudinally over the channel's length and is sized such that the height of the opening is smaller than the cross-sectional dimension of the hinge pin 38.

Each arcuate flange 44 is formed of a resilient material capable of deforming upwardly away from the lower flanges 48 and deck a sufficient distance to allow the hinge pin 38 to snap through the opening 52 into the channel. In addition, the hinge pin is formed of a resilient material capable of deforming to assist the hinge pin 38 to snap into the channel. The hinge pins may be snapped into place into the hinge receptacle when the hatch cover 10 is in an open position and the hinge pins 38 are aligned with the openings 52 in the respective hinge receptacles. A force is then placed on the hatch cover and the hinge pins inward toward the back of the channels. The beveled edges 43 and 45 of the arcuate and lower flanges then guide the hinge pins into the opening 52. This causes the arcuate flange to deform upwardly away from the lower flanges, thus allowing the hinge pin to snap into the channel. As the arcuate flange deforms upwardly, the hinge pin deforms downwardly to help the hinge pin snap into the channel.

The hinge pins 38 are held in place by the combination of the inner surfaces 46 of the arcuate flanges engaging the outer surface of the hinge pins and the upper surfaces 50 of the lower flanges engaging the rounded ends 37 of the arms 36. As the door is opened or closed, the hinge pins 38 rotate within the hinge receptacle, the inner surfaces 46 of the arcuate flanges serving as upper bearing surfaces and the upper surfaces of the lower flanges serving as lower bearing surfaces.

Numerous materials are particularly suited for the construction of the hinge receptacles 34 as long as they are capable of deforming without breaking and of withstanding the harsh environment in which the hatch is used. An illustrative material that could be used to form the hinge receptacles, frame, and hatch cover is polyvinylchloride; however, other materials could also be used.

It may be beneficial to fabricate the hatch cover 10 and hinge bracket 32 as an integral part in order to reduce manufacturing costs but separate pieces could also be used. Similarly, it may be beneficial to fabricate the frame 12, including arcuate flanges 44 and lower flanges 48 as an integral part, but separate parts could also be used. In the preferred embodiment, the hatch cover and frame were fabricated using an injection molding operation. However, other methods of fabrication could also be used.

Figure 5:
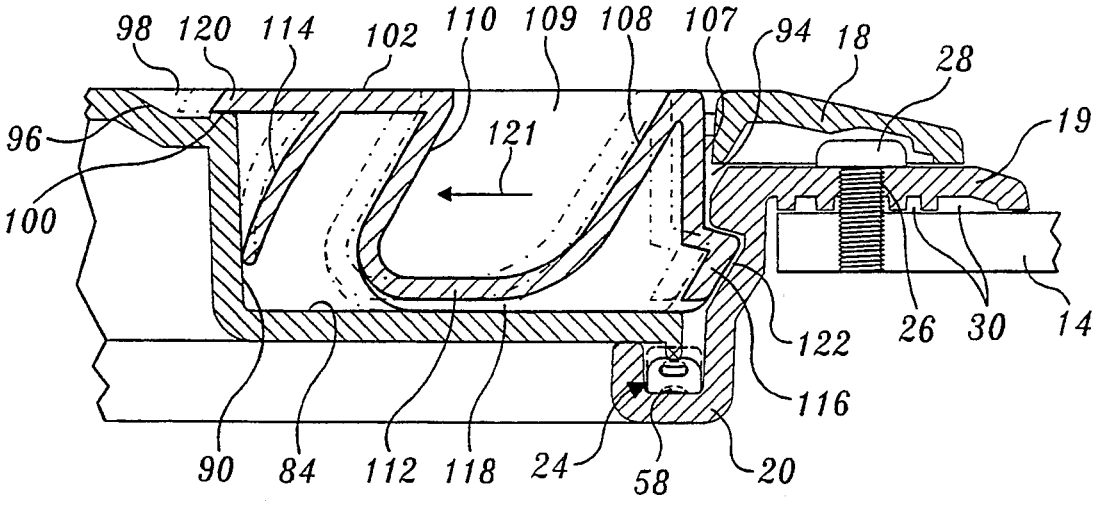
FIG. 5 is an enlarged cross-sectional view of the hatch and handle taken along section line 5—5 of FIG. 1.
Figure 4:
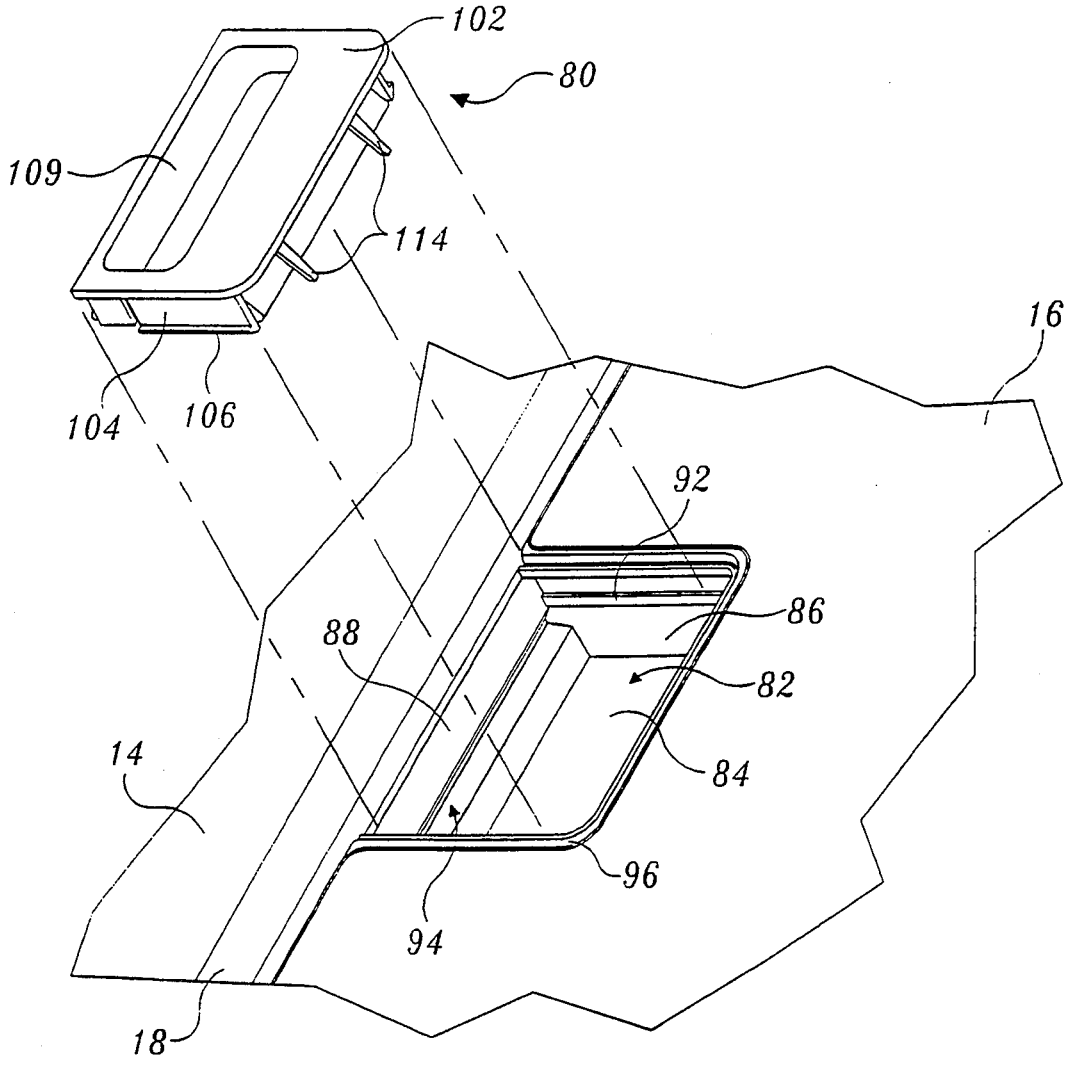
FIG. 4 is an enlarged exploded view of a portion of the hatch and handle of FIG. 1.
Figure 6:
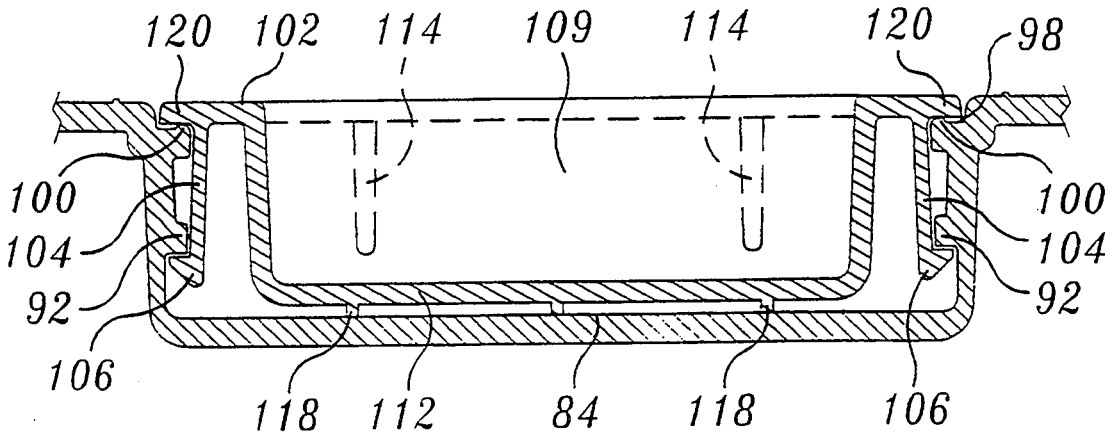
FIG. 6 is an enlarged cross-sectional view of the hatch and handle taken along section line 6—6 of FIG. 1, normal to the cross section of FIG. 5.

Referring now to FIGS. 4, 5, and 6, the hatch cover 10 includes a handle receptacle 82 located on the side of the hatch cover opposite the hinge assemblies 46. The handle receptacle extends downwardly from the top 16 of the hatch cover and is defined by a bottom 84, two parallel sides 86 extending across the width of the handle receptacle perpendicular to the edge of the hatch cover, and front 88 and back 90 walls extending parallel to the edge of the hatch cover. Each sidewall 86 includes a retaining structure comprising a ledge 92 (FIGS. 4 and 6) that extends across the width of the sidewall parallel to the bottom 84. The ledges 92 are adapted to engage the handle 80 in order to maintain it in the handle receptacle and allow it to reciprocate relative to the front and back walls as will be described hereinafter. The front wall 88 of the handle receptacle includes a hole or slot 94 extending over the width of the front wall, parallel to the bottom 84. The slot 94 allows a latch located on the handle to extend through the front wall and engage the frame as will be described below.

The upper edge 96 of the handle receptacle is recessed around its periphery in order to form a channel 98 in the top of the hatch cover. The channel 98 allows water and sand to drain out from between the upper wall 102 of the handle and the top of the hatch cover as will be described in more detail hereinafter. The inner edge of the channel adjacent the handle receptacle then extends upwardly to form a step 100 upon which the upper wall 102 of the handle rides as described in more detail below.

As best illustrated in FIGS. 4, 5 and 6, handle 80 has an upper wall 102 that extends approximately parallel to the top 16 of the hatch cover and two opposing sides 104 that extend downwardly from opposite sides of the upper wall parallel to the sidewalls 86 of the handle receptacle. At the bottom edge of each side 104 is a shoulder 106 that extends outward from the exterior surface of the side over its length parallel to the ledges 92 in the handle receptacle. The sides 104 are formed of a resilient, flexible material which allows them to be compressed inwardly toward each other so that the handle 80 can be pressed into place within the handle receptacle 82 as described below.

The handle 80 also includes a front wall 107 facing the front 88 of the handle receptacle and extending downwardly from the upper wall of the handle. A latch 116 is located on the bottom portion of the front wall and extends outwardly toward the edge of the hatch cover. The latch 116 is adapted to extend through the slot 94 in the handle receptacle in order to engage the recess in the J-shaped edge 20 of the frame when the hatch cover is in a closed and latched position as will be described in more detail below.

Handle 80 also includes a cavity 109 that extends downwardly from the upper wall 102 of the handle and is adapted to receive an operator's fingers. The cavity 109 is defined by parallel front 108 and rear 110 walls that extend downwardly from the upper wall 102 of the handle parallel to the front 88 of the handle receptacle and a bottom 112 that extends parallel to the bottom 84 of the handle receptacle. The front and rear walls also slant rearwardly toward the back 90 of the handle receptacle, in order to provide the operator with a better finger grip.

A plurality of runners 118 (FIG. 6) extend downwardly from the lower surface of the bottom 112 parallel to the sides 104 of the handle. As best illustrated in FIGS. 4 and 5, the handle also includes a biasing structure having two resilient biasing members 114 although one or more could be used extending downwardly and rearwardly from the upper wall 102 of the handle in order to contact the back wall 90 of the handle receptacle.

When the handle 80 is pressed into the handle receptacle 82, the sides 104 extend downwardly into the handle receptacle and expand such that the top of the shoulders 106 engage the bottom edge of ledges 92 (FIG. 6) in order to slidably retain the handle within the handle receptacle. In addition, the bottom of the outer edge 120 of the upper wall of the handle extends over and contacts the step 100 in the edge of the handle receptacle. The combination of the bottom of the outer edges 120 contacting the step 100 and the shoulders 94 contacting the ledges 88 maintains the handle within the handle receptacle.

The runners 118 contact the bottom 84 of the handle receptacle and serve as a running surface for the handle. In addition, the runners maintain the bottom 112 of the handle above the bottom of the handle receptacle 84 thus allowing water and grit to flow out from in between the handle and handle receptacle. Similarly, the channel 98 extends under the outer edge 120 of the upper walls of the handle, thus allowing water and grit to flow out from in between the handle and the hatch cover. This helps to ensure that sand and grit does not cause the handle to bind or catch when it is moved.

In its undeformed shape, the handle lies adjacent to the front 88 of the handle receptacle as shown in FIG. 5. In this position, the latch 116 extends through the slot 94 in the handle receptacle and engages a retaining groove 122 in the J-shaped edge 20 of the frame 12, thus maintaining the hatch cover in a closed and latched position. As the handle is slid rearwardly (as shown by arrow 121) toward the back 90 of the handle receptacle, the biasing members 114 are deformed thus storing energy of deformation. At the same time, the latch 116 is moved out of contact with the retaining groove 122, thus allowing the hatch cover to be opened. Upon releasing the handle, the energy stored in the biasing members 114 moves the handle back toward the front 88 of the handle receptacle such that the latch 116 extends through the slot 94 in the hatch cover and into the retaining groove 122, thus latching the hatch cover in a closed and latched position.

In order to increase durability and reduce fabrication costs, the preferred embodiment of the handle shown is fabricated as a single piece. However, multiple pieces that are then joined to form the handle could also be used. In addition, the handle is formed from a tough, resilient material such as Acetal or other plastic material, in an injection molding process. However, other materials and fabrication processes could also be used.

An alternate method to attach the hatch to the deck 14 is illustrated in FIG. 11. In this embodiment, the frame 12 includes a series of cylindrical projections 124, including a bore 126 therethrough, extending downwardly from the bottom of the J-shaped edge 20. The lower portion of each cylindrical projection 124 is received within a cavity formed by a cylindrical holder 128. The frame is attached to the cylindrical holders 128 through the use of fasteners 130 that extend through the J-shaped edge, the bores 126 and into an aperture 131 in the center of the cylindrical holders. The cylindrical holders include a resilient planer arm 132 that extends outwardly and upwardly from the exterior surface of each cylindrical holder 128 into contact with the lower surface of the deck 14. The combination of the arm 132 contacting the lower surface of the deck and the rim 19 contacting the upper surface of the deck sandwiches the deck in between structure of the frame, thus holding the hatch in place.

FIGS. 7 through 10 show a second embodiment of the present invention that is intended to be mounted on an interior panel, such as a bulkhead or wall, where it is not important to maintain a tight, weather-resistant seal between the hatch and the panel. To this end, a frame as described in the first embodiment is not required and is advantageously eliminated in order to reduce costs. Details of the second embodiment not discussed herein are similar to the first embodiment and can be understood by reference to the discussion thereof.

The second embodiment comprises a hatch consisting of a generally panel hatch cover 140 similar to the hatch cover of the first embodiment. The hatch cover includes two hinge assemblies 142 longitudinally spaced along one edge of the hatch cover and a handle 144 and latch 146 (FIG. 10) located on the opposite edge of the hatch cover. In the second embodiment, each hinge assembly comprises a hinge receptacle having an arcuate flange 148 and a hinge bracket 150 including a hinge pin 152. In the second embodiment, the arcuate flange 148 is formed as a separate piece having a flat portion 154 extending parallel to the upper surface of the panel (FIG. 8) and including two apertures 156 contained therein. This allows two fasteners 158 to extend through the arcuate flange into the deck, thus securing the arcuate flange to the deck. The fasteners 158 could be bolts, screws or similar fastening devices.

The hinge brackets include two arms 160 that are longitudinally spaced apart and extend outwardly past the edge of the hatch cover. A cylindrical hinge pin 152 extends parallel to the edge of the hatch cover in between the ends of the two arms. The arms extend outwardly past the edge of the hatch cover a sufficient distance to maintain a gap in between the edge of the hatch cover and the hinge pins. The ends 164 of the arms are rounded in order to serve as a bearing as described below and in more detail in the discussion of the first embodiment.

Each arcuate flange 148 extends longitudinally parallel to the edge of the hatch cover upwardly from the upper surface of the panel through the gap in between the edge of the hatch cover and the hinge pin. The arcuate flanges then arch outwardly over the hinge pins to form inner surfaces 150 adapted to conform to the outer surface of the hinge pins in a manner similar to that described in the first embodiment. However, in the second embodiment, the upper surface of the deck serves as the lower bearing surface for the rounded ends 164 of the arms as opposed to the lower flanges 48 in the first embodiment. Otherwise, the structure and operation of the hinge assemblies in the second embodiment are similar to that of the first embodiment and may be understood by reference to detailed disclosure thereof.

The operation and structure of the handle 144 of the second embodiment is the same as that described for the first embodiment, except that latch 146 of the second embodiment engages a separate latch receptacle 170 as opposed to the frame shown in the first embodiment. The latch receptacle 170 is a separate piece mounted on the edge of the opening in the panel and includes a flat portion 172 extending parallel to the upper surface of the panel and further including two apertures 174 contained therein. Two fasteners 176 extend through the apertures and into the panel in order to attach the latch receptacle to the deck panel. Each fastener 176 may be a bolt, screw or similar fastening device. The latch receptacle also includes a lower portion 178 that extends downwardly over the edge of the panel in order to serve as a latch catch 180 adapted to contact and engage the latch 146 when the handle is in the latched position. Other elements of the hatch are the same as the first embodiment and may be understood by reference to the detailed disclosure thereof contained herein.

Figure 7:
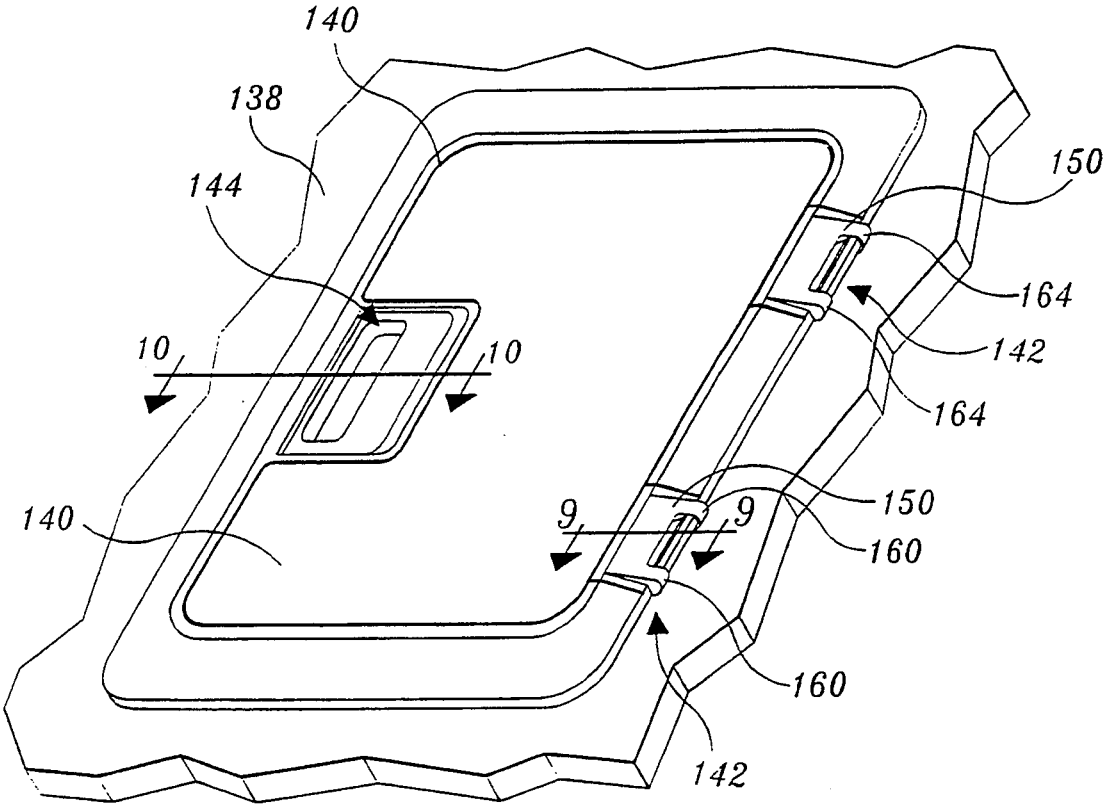
FIG. 7 is a perspective view of a second embodiment of the present invention.
Figure 8:
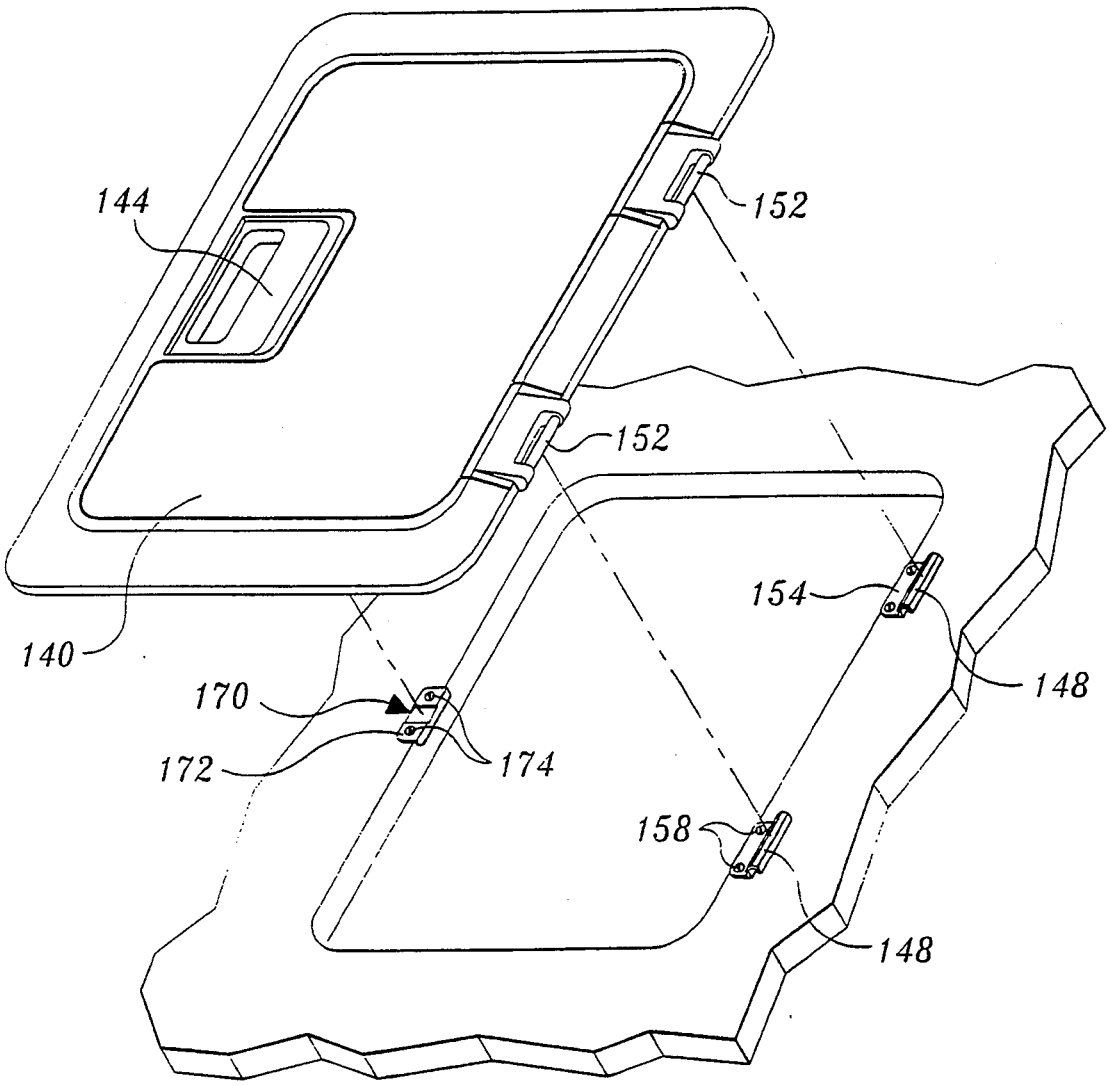
FIG. 8 an exploded view of the hatch, hinge receptacle, and strike plate of FIG. 7.

In alternate embodiments not shown, the upper wall of the hatch cover could include a depressed portion, the outer perimeter which is defined by line 140 in FIG. 7. The depressed portion would allow a decorative insert to be placed within the upper surface of the hatch cover. As an illustrative example, carpeting or paneling could be placed within the depression, thus allowing the hatch cover to be aesthetically tailored to fit in with the decor of the boat or other structure it is mounted on.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A latch assembly, comprising:

(a) a handle receptacle adapted for use with a cover, the handle receptacle including opposing sides, a back wall, and retaining means, for maintaining a handle in the handle receptacle, coupled to the opposing sides, the retaining means including a ledge extending outwardly from the opposing sides; and (b) a handle slidably mounted within the handle receptacle so as to be movable from a latched position to an unlatched position, the handle including:

(1) a top adapted to be approximately flush with a top of the handle receptacle;

(2) opposing walls extending downwardly from the top, each wall including a shoulder adapted to slidably engage a bottom surface of the ledge to maintain the handle in the handle receptacle;

(3) a latch located near one end of the handle, adapted to engage a latch receptacle when the handle is in the latched position; and (4) biasing means for biasing the handle toward the latched position.

2. The latch of claim 1, wherein the biasing means comprises a resilient member extending downwardly from the top of the handle so as to contact the back wall of the handle receptacle such that the resilient member deforms as the handle is slidably moved from the latched position to the unlatched position.

3. The latch of claim 1, wherein the handle further includes at least one runner extending downwardly from a bottom surface of the handle such that the runner contacts a bottom of the handle receptacle and serves as a running surface upon which the handle slides.

4. The latch of claim 1, wherein the handle is formed as a single piece.

5. The latch of claim 1, wherein the handle receptacle further comprises a drainage channel located near an upper edge of the handle receptacle such that the drainage channel extends at least partially under the top of the handle, thereby allowing water and grit to flow out from in between the top of the handle and the handle receptacle.

6. The latch of claim 1, wherein the top of the handle is generally planar and wherein the handle includes a cavity, adapted to serve as a finger grip, extending downwardly from the top of the handle.

7. The latch of claim 1 wherein the retaining means comprises at least one shoulder extending at least partially along the length of the opposing sides.

8. A handle adapted to be slidably mounted in a handle receptacle so as to be movable from a latched position to an unlatched position, the handle comprising:

(a) a top adapted to be approximately flush with a top of the handle receptacle;

(b) opposing walls extending downwardly from the top, each wall including a shoulder adapted to slidably engage a retaining means projecting from sidewalls of the handle receptacle, for maintaining the handle in the handle receptacle;

(c) a latch located near one edge of the handle and extending downwardly from the top, the latch being adapted to engage a latch receptacle when the handle is in the latched position; and (d) biasing means, located near one end of the handle, for engaging the handle receptacle and biasing the handle towards the latched position.

9. The handle of claim 8, wherein the biasing means comprises a resilient member extending downwardly from the top of the handle so as to contact the handle receptacle such that the resilient member deforms as the handle is slidably moved from the latched position to the unlatched position.

10. The handle of claim 8, further comprising at least one runner extending downwardly from a bottom surface of the handle and being adapted to contact a bottom of the handle receptacle and serve as a running surface upon which the handle slides.

11. The handle of claim 8, wherein the handle is formed as a single piece.

12. The handle of claim 8, wherein the top of the handle is generally planar and is adapted to form a smooth surface, wherein the handle includes a cavity, adapted to serve as a finger grip, extending downwardly from the top of the handle.

13. A latch assembly, comprising:

(a) a handle receptacle adapted for use with a cover, the handle receptacle including opposing sides, a back wall, and retaining means, for maintaining a handle in the handle receptacle, coupled to the opposing sides; and (b) a handle slidably mourned within the handle receptacle so as to be movable from a latched position to an unlatched position, the handle including:

(1) a top adapted to be approximately flush with a top of the handle receptacle;

(2) a wall extending downwardly from the top and being adapted to slidably engage the retaining means in the handle receptacle;

(3) a latch, located near one end of the handle, adapted to engage a latch receptacle when the handle is in the latched position; and (4) biasing means, located near one edge of the handle, for engaging the handle receptacle and biasing the handle towards the latched position, wherein the handle receptacle also includes a drainage channel located near an upper edge of the handle receptacle such that the drainage channel extends at least partially under the top of the handle so as to allow water and grit to flow out from in between the top of the handle and the handle receptacle.

14. The latch assembly of claim 13, wherein the biasing means comprises a resilient member extending downwardly from the top of the handle so as to contact the back wall of the handle receptacle so that the resilient member deforms as the handle is slidably moved from the latched position to the unlatched position.

15. The latch assembly of claim 13, wherein the handle further includes at least one runner extending downwardly from a bottom surface of the handle such that the runner contacts a bottom of the handle receptacle and serves as a running surface upon which the handle slides.

16. The latch assembly of claim 13, wherein the top of the handle is generally planar and wherein the handle includes a cavity, adapted to serve as a finger grip, extending downwardly from the top of the handle.

* * * * *

UNITED STATES PATENT AND TRADEMARK OFFICE

CERTIFICATE OF CORRECTION

PATENT NO. : 5,358,291

DATED : October 25, 1994

INVENTOR(S) : J.A. Malmanger et al.

It is certified that error appears in the above-indentified patent and that said Letters Patent is hereby corrected as shown below:

Title page, Item [56] Column 2, insert;

| COLUMN | LINE | |
|---|---|---|
| [56] (Col. 2) | Refs. Cited (U.S. Pat Docs) | Insert --311,953 2/1885 Burgess ..... --/-- |
| [56] (Col. 2) | Refs. Cited (U.S. Pat Docs) | Insert --630,886 8/1899 Held .....--/-- |
| [56] (Col. 2) | Refs. Cited (U.S. Pat Docs) | Insert --896,282 8/1908 Durkee ..... --/-- |
| [56] (Col. 2) | Refs. Cited (U.S. Pat Docs) | Insert --2,051,757 8/1936 Travis .....20/69-- |
| [56] (Col. 2) | Refs. Cited (U.S. Pat Docs) | Insert --3,130,651 4/1964 Werner .....94/36-- |
| [56] (Col. 2) | Refs. Cited (U.S. Pat Docs) | Insert --3,209,663 10/1965 Baier .....94/35-- |
| [56] (Col. 2) | Refs. Cited (U.S. Pat Docs) | Insert --3,773,338 11/1973 Fidler et al. .....277/95-- |
| [56] (Col. 2) | Refs. Cited (U.S. Pat Docs) | Insert --4,846,089 07/1989 Cedergreen .....114/201-- |
| [56] (Col. 2) | Refs. Cited (For. Pat Docs) | Insert --243,679 11/1965 Austria-- |

UNITED STATES PATENT AND TRADEMARK OFFICE

CERTIFICATE OF CORRECTION

PATENT NO. : 5,358,291
DATED : October 25, 1994
INVENTOR(S) : J.A. Malmanger et al.

Figure 9:
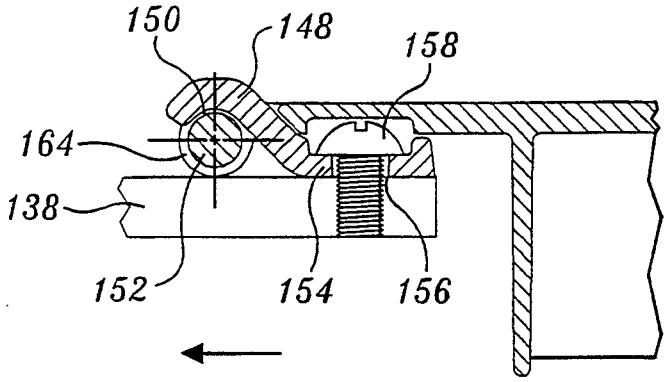
FIG. 9 an enlarged cross-sectional view of the hatch and hinge receptacle taken along section line 9—9 of FIG. 7.
Figure 10:
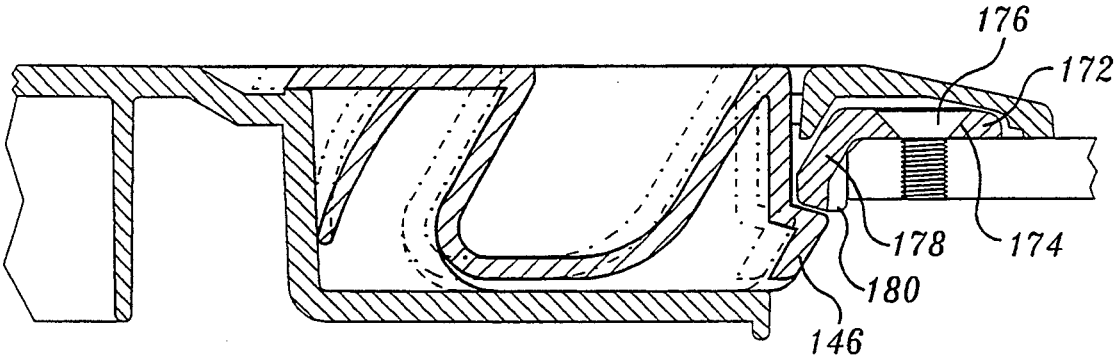
FIG. 10 is an enlarged cross-sectional view of the hatch and strike plate taken along section line 10—10 of FIG. 7.

It is certified that error appears in the above-indentified patent and that said Letters Patent is hereby corrected as shown below:

| COLUMN | LINE | |
|---|---|---|
| [56] (Col. 2) | Refs. Cited (For. Pat Docs) | Insert --523,560 1/1939 United Kingdom-- |
| 2 (Pg. 1, Col. 2) | Abstract (Line 1) | Delete "is provided" |
| 2 | 42 | "panel; ." should read --panel;-- |
| 2 | 43 | "Is" should read --is-- |
| 2 | 60 | "FIG. 9 an" should read --FIG. 9 is an-- |
| 3 | 16 | "pans" should read --parts-- |
| 3 | 40 | "comers" should read --corners-- |
| 10 | 64 | "mourned" should read --mounted-- |

Signed and Sealed this

Seventh Day of February, 1995

*Attest:*

Bruce Lehman

BRUCE LEHMAN

*Attesting Officer*

*Commissioner of Patents and Trademarks*